United States Patent [19]

Clay et al.

[11] 4,305,577

[45] Dec. 15, 1981

[54] APPARATUS FOR APPLYING, VARYING AND REMOVING A NORMAL FORCE IN A SHINGLER WHEEL TYPE DOCUMENT FEEDER

[75] Inventors: Sherwood A. Clay, Boulder, Colo.; Richard A. Lamos, Delray Beach, Fla.

[73] Assignee: International Business Machines Corporation, Armonk, N.Y.

[21] Appl. No.: 63,622

[22] Filed: Aug. 3, 1979

[51] Int. Cl.[3] ..... B65H 3/06

[52] U.S. Cl. ..... 271/119; 271/126; 271/160; 271/165

[58] Field of Search ..... 271/119, 120, 126, 165, 271/160

[56] References Cited

U.S. PATENT DOCUMENTS

| | | | |
|---|---|---|---|
| Re. 27,976 | 4/1974 | Sahley | 355/64 |
| 566,670 | 8/1896 | Dummer . | |
| 781,504 | 1/1905 | Dummer . | |
| 798,857 | 9/1905 | Zander | 271/119 |
| 3,008,709 | 11/1961 | Buslik | 271/10 |
| 3,823,936 | 7/1974 | Quist | 271/126 X |
| 3,861,671 | 1/1975 | Hoyer | 271/122 |
| 3,869,116 | 3/1975 | Kroeker | 271/126 X |
| 3,937,455 | 2/1976 | Hauser | 271/10 |
| 3,977,668 | 8/1976 | Bologna | 271/126 |
| 4,126,305 | 11/1978 | Colglazier | 271/120 |

FOREIGN PATENT DOCUMENTS 1427357 3/1976 United Kingdom .

*Primary Examiner*—Richard A. Schacher

*Attorney, Agent, or Firm*—Joscelyn G. Cockburn; John H. Holcombe

[57] ABSTRACT

A normal force applicator and removal apparatus which applies, varies and removes force applied to the top of a document stack where documents are being fed, i.e., by a shingler wheel type document feeder, (also termed combing wheel or wave generator) in order to generate a shingled stack of documents for subsequent processing. The shingler wheel is adjustable so that it can be centered for document stacks of multiple lengths. In order to shingle documents at a practical and predictable rate, i.e., maintain a shingled stack of documents, and to avoid skewing of the documents as they are shingled, the normal force is varied as a function of the thickness of the document stack decreasing as the document stack is depleted, and the normal force is applied symmetrically from the center of the shingler wheel to either side thereof. This symmetrical force distribution is maintained throughout the range of adjustment of the shingler wheel.

18 Claims, 9 Drawing Figures

APPARATUS FOR APPLYING, VARYING AND REMOVING A NORMAL FORCE IN A SHINGLER WHEEL TYPE DOCUMENT FEEDER

BACKGROUND OF THE INVENTION

1. Field of the Invention

The present invention relates to a normal force applicator and removal apparatus for applying and removing a normal force to a document stack and a shingler wheel movable to accommodate multiple document stack lengths, and more specifically, to accomplish the foregoing while decreasing the normal force as the document stack is depleted to shingle documents at a substantially predetermined constant rate.

2. Prior Art

The technological advances made in the speed of producing a copy sheet from a document, in an electrophotographic copier system, has necessitated the development of automatic document feeders (ADF) and recirculating automatic document feders (RADF) to enable the aforementioned electrophotographic copier system to produce copy sheets at its full speed rate. Accordingly, the prior art is replete with such automatic feeder devices.

Some of the techniques in document feeders, used to separate documents from a document stack include belt separators, vacuum separators, friction roller separators and combing wheel, wave generator or shingler wheel type separators.

Each of the foregoing types of document feeders have advantages and disadvantages and require, in varying degrees, unique and highly specialized cooperating devices to properly separate documents from a document stack for subsequent processing. In the present invention, a modern version of the combing wheel is used to feed or shingle documents from a document stack to generate a shingled stack. Unique problems are presented when a combing wheel is used to feed documents from the bottom of a document stack as opposed to the more common use of a combing wheel to feed documents from the top of a document stack as will be described. The present invention is concerned with a normal force applicator and removal apparatus for cooperating with a combing wheel feeding or shingling sheets from the bottom of a stack.

A modern version of a combing wheel suitable to be used with the present invention is disclosed in U.S. Pat. No. 4,126,305 to Colglazier, et al, entitled "Combing Wheel," filed Apr. 18, 1977, patented Nov. 21, 1978 and assigned to the same assignee as the present invention. Also, the use of combing wheel type feeders to feed cut sheets to a printer is documented in several U.S. Patents to Dummer. Exemplary examples are: U.S. Pat. No. 566,670 to Dummer entitled "Paper Feeding Machine," issued on Aug. 25, 1896 from application Ser. No. 491,760, filed Nov. 28, 1893; and U.S. Pat. 781,504 to Dummer entitled "Paper Feeding Machine," issued on Jan. 31, 1905 from Application Ser. No. 734,030, filed Oct. 18, 1899.

Modern applications of the combing wheel technology are disclosed in serveral IBM Technical Disclosure Bulletin Articles. Exemplary examples are: Hunt, "Envelope Shingling Apparatus," Vol. 19, No. 10, March 1977, pgs. 3628–3629; Hunt, "Cover Sheet Feeding Apparatus," Vol. 19, No. 10, March 1977, pg. 3630; Hunt et al, "Sheet Shingler," Vol. 20, No. 2, July 1977, pg. 497; Avritt, "Bottom Sheet Paper Feed," Vol. 20, No. 2, July 1977, pg. 496; Hunt, "Trailing Edge Paper Feeding Apparatus," Vol. 20, No. 5, October 1977, pg. 1678; Fallon et al, "Sheet Shingler," Vol. 21, No. 2, July 1978, pgs. 477–478; Rosati, "Jam-Free Shingling Aperture," Vol. 21, No. 9, February 1979, pg. 3530; Markham et al, "Shingling Depletion Sensor," Vol. 21, No. 9, February 1979, pgs. 3538–3539; Markham et al, "Double Restraint Gate for Wave-Generator Feeder System" Vol. 21, No. 9, February 1979, pgs. 3540–3542; and Fallon et al, "Sheet Feed Apparatus," Vol. 21, No. 12, May 1979, pgs. 4765–4767.

The present invention incorporates a unique normal force applicator and removal apparatus in cooperation with a combing wheel, wave generator or shingler wheel type feeder disposed to feed from the bottom of a document stack. The normal force applicator and removal apparatus is configured and operated such that most of the problems associated with this bottom type feeder system are eliminated. The problems solved by the present invention and the consequences of their solution are that the shingled stack is not skewed; the rate of shingling is controllable and predictable regardless of the kind or condition of the documents in the document stack and regardless of the height of the document stack; and, the risk of damage to light-weight documents, especially if the document stack is near depletion, is minimized.

As aforementioned, in document feeders and sheet feeders, various techniques have been used to separate sheets or documents from a stack. One example is U.S. Pat. No. 3,861,671 to Hoyer, entitled "Liftable Bail Bar for Allowing Return of Multi-Ply Separated Sheets to Stack" which discloses a bail bar for forcing a stack of sheets against a separator roller (friction type) thereunder to provide a normal force to assist in the feeding of sheets singularly from the stack. Provided downstream of the separator roller is a feed roller for feeding a single sheet forward and a reversing roller for returning any erroneously fed multiple sheets, other than the single sheet, back to the stack. The bail bar is liftable from atop the stack to minimize drag on a separated sheet and to allow the multiple fed sheet pushed towards the stack by the reversing roller to be returned thereto.

Another example is U.K. Pat. No. 1,427,357 to Brooke, entitled "Sheet Feeding Method," which discloses a system for feeding copy sheets from a stack to a transfer station, in an electrophotographic copier, such that a wave is created in at least the uppermost sheet(s) in the stack when it is contacted intermittently by freely rotatable rollers in cooperation with radially extending arms.

Yet another example is U.S. Pat. No. 3,008,709 to Buslik, entitled "Sheet Separating and Feeding Apparatus," which discloses a sheet separating and feeding apparatus for successively separating the top sheets of a stack of sheets, and for feeding the successively separated sheets from the stack. The apparatus is capable of handling a stack of mixed sheets in which the sheets may be of various materials of nonuniform dimensions and weight. The separator member (a shingler wheel) is mounted by a shaft for movement between an active position and an inactive position and is disposed adjacent to the stack of documents so that rotatable members, included therein, are rotatable in a plane substantially parallel with the sheets in the stack. Hence, when contact of the separator member is made with the uppermost sheets of the stack, they are simultaneously displaced in varying degrees about the axis of rotation of the shaft of the separator member in a fan-like fashion.

Still another example is U.S. Pat. No. 781,504 to Dummer, entitled "Paper-Feeding Machine," which discloses an apparatus comprising a separating mechanism, i.e., a shingler wheel, by which sheets are fanned out from a stack thereof located on a convex support surface of the separating mechanism formed by a number of traverse rollers which are caused to rotate opposite and in conformity to the convex surface. In addition, a device for regulating the movement of the rollers to engage the delivery of the sheets individually as required by an associated machine to be fed is also disclosed. In this reference, mention is made of U.S. Pat. Nos. 566,670 and 566,671 also to Dummer and relating to the same subject matter. As far as is known, these two references are the earliest patented use for a combing wheel, wave generator or shingler type feeder.

While the foregoing references disclose combing wheel, wave generator or shingler wheel type of feeders, (see, for example, Brooke, Buslik or Dummer), and a bail bar, i.e., a normal force applicator, cooperating with a separator means, i.e., a friction roller (see, for example, Hoyer), the prior art is not concerned with the previously mentioned problems solved by the present invention. Consequently, there is no teaching separately or in combination of the use of a normal force applicator and removal apparatus in combination with a bottom disposed shingler wheel for shingling at a substantially constant predetermined rate to maintain a shingled stack of documents regardless of the height of the document stack while substantially eliminating skewing of the shingled stack. Hence, there is a need in the prior art for a device such as disclosed and claimed herein.

The prior art, as indicated hereinabove, includes some advances in combing wheels, wave generator or shingler wheel type feeders, and some advances in bail bar or normal force applicators. However, insofar as can be determined, no prior art device or method incorporates the features and advantages of the present invention.

OBJECTS OF THE INVENTION

Accordingly, an important object of the present invention is to apply a uniform (unbiased) normal force to the top of a document stack and to the geometric center of a shingler wheel configured to generate a shingled document stack from the bottom of a document stack, and configured to be movable to accommodate document stacks of multiple lengths, regardless of the location thereof.

Another important object of the present invention is to vary the applied normal force as a function of the thickness of the document stack such that the applied normal force is decreased as the document stack is depleted.

Yet another important object of the present invention is to counterbalance the weight of the normal force applicator and removal apparatus to substantially zero, when a normal force is not being applied, to facilitate loading of the document stack thereunder.

Still another important object of the present invention is to configure the normal force applicator and removal apparatus to serve as a loading guide for the document stack thereby substantially eliminating curling and disfiguration of the edges of the top documents therein.

A further important object of the present invention is to configure the normal force applicator and removal apparatus, at the interface between it and the document stack, to simulate a document stack in order to facilitate shingling of the last few documents of the document stack.

Still a further important object of the present invention is to configure the normal force applicator and removal apparatus, at the interface between it and the document stack, to simulate the surface of a single document in order to facilitate shingling of the last document of the document stack.

SUMMARY OF THE INVENTION

The normal force applicator and removal apparatus, according to the present invention, by which the foregoing and other objects, features and advantages are accomplished and realized is characterized, inter alia, by a normal force applicator and removal means, a counterbalance means, a normal force executing means and a normal force control means.

The normal force applicator and removal apparatus is configured to apply a normal force to the top of a document stack such that documents are shingled from the bottom thereof by a shingler wheel to form a shingled stack. A normal force applicator and removal bar is disposed on the top of the document stack directly above the shingler wheel with the document stack therebetween, and is attached to left and right links which pivot about points on left and right support plates, respectively. This allows the normal force applicator and removal bar to pivot up to accept the document stack in a document tray and to pivot down as documents are shingled by the shingler wheel. The magnitude of the normal force applied to the top of the document stack is directly proportional to the height or thickness of the document stack.

The normal force is uniquely applied and removed from the top of the document stack by using a cable system which transmits a spring force applied to the right link to the shingler wheel such that the normal force is always perpendicular to the geometric center of the shingler wheel throughout the adjustment range thereof, thereby eliminating skewing of the documents as they are shingled.

A counterbalance device, situated between the aforementioned front and rear support plates, operates to partially support the weight of the normal force applicator and removal bar and its associated linkages, thereby eliminating from the top of the document stack the drag that would be created thereby. It also operates to reduce the force necessary to cam up the normal force applicator and removal bar for insertion of the document stack in the document tray. In addition, the counterbalance device maintains tension in the cable system, which in turn keeps the normal force applicator and removal bar parallel to the document stack when normal force is not being applied to the top thereof.

BRIEF DESCRIPTION OF THE DRAWINGS

The foregoing and other objects, novel features and advantages of the invention will be more apparent from the following more particular description of the preferred embodiment as illustrated in the accompanying drawings, in which.

DESCRIPTION OF THE PREFERRED EMBODIMENT

The following is a brief description of the normal force applicator and removal apparatus, according to the invention, used in conjunction with a shingler wheel type automatic document feeder. A more detailed description of some aspects of the apparatus and operation of the complete apparatus is described hereinafter under the heading "Statement of the Operation."

Figure 1:
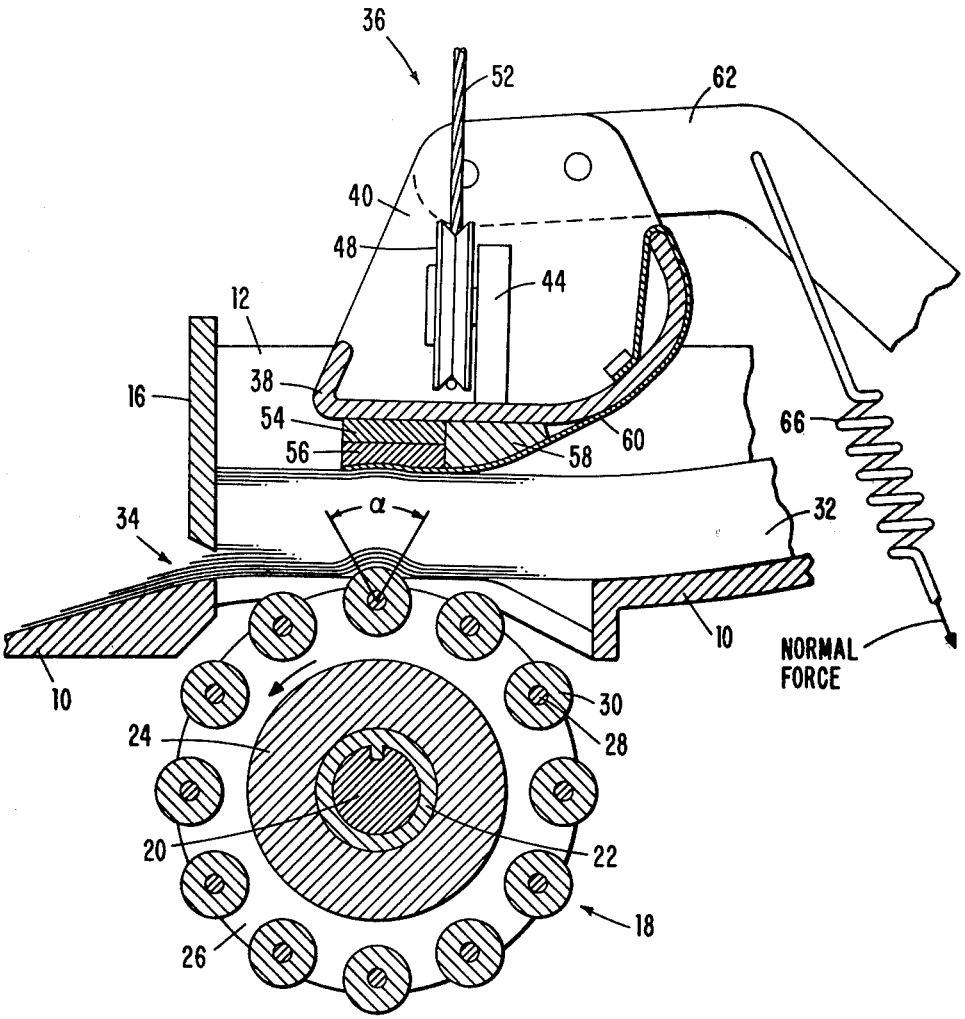
FIG. 1 is a left side sectional view of the apparatus, according to the invention, illustrating, inter alia, the line of action of an applied normal force through the document stack to the geometric center of the shingler wheel, and the "wrap" angle form by the normal force.
Figure 2:
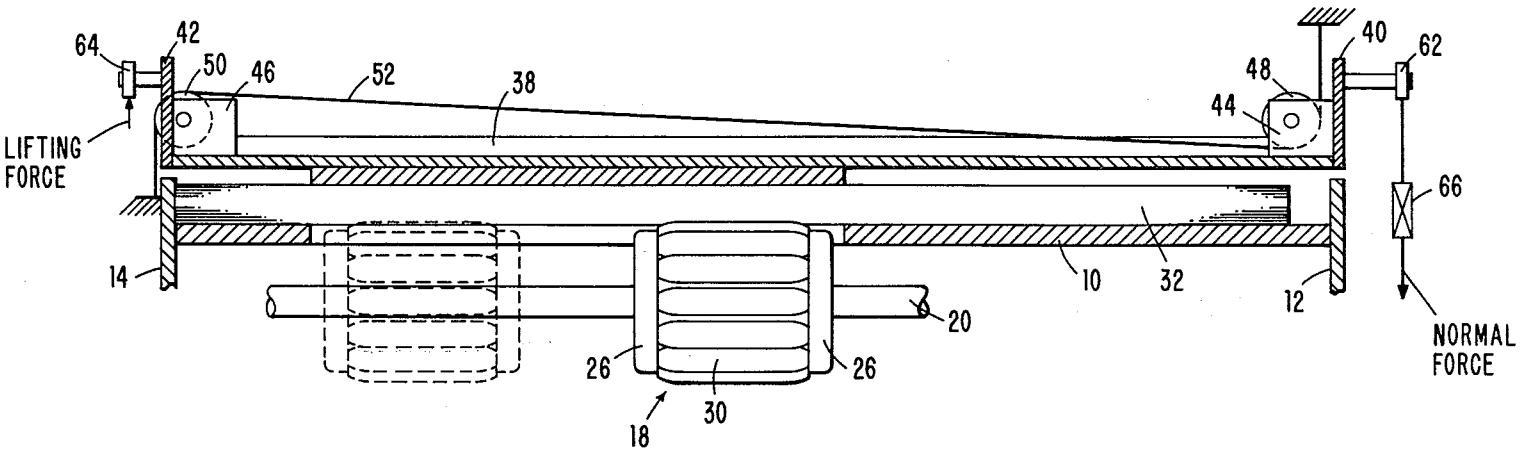
FIG. 2 is a front sectional view of the apparatus, according to the invention, depicting, inter alia, the position of the shingler wheel centered under a maximum length document stack and the range of adjustment thereof, depicted by a dotted outline, for a minimum length document stack.

Referring then to FIGS. 1 and 2 concurrently, the apparatus comprises, inter alia, a document tray 10, right and left support plates 12 and 14, respectively, fixedly attached to document tray 10 and a gross shingler bar 16 also fixedly attached to the afore-mentioned document tray 10.

Disposed below document tray 10 is a shingler wheel 18 situated for rotation in a counterclockwise direction on main drive shaft 20 driven by a motor (not shown). Shingler wheel 18 comprises, inter alia, a shingler sleeve 22 slidably keyed to main drive shaft 20 and a shingler hub 24 slidably attached to shingler sleeve 22 and fixedly attached to shingler flange 26. A plurality of shingler roller shafts 28 are fixedly attached to shingler flange 26 around the periphery thereof. One each of cylinder-like rollers 30 are rotatably connected to one each of the aforementioned shingler roller shafts 28.

Document stack 32 is normally placed in document tray 10 up against gross shingler bar 16, and in operation, (to be discussed more fully hereinafter under the heading "Statement of the Operation"), a shingled stack 34 is generated therefrom by the coaction of shingler wheel 18 and normal force applicator and removal device 36.

Still referring to FIGS. 1 and 2 concurrently, normal force applicator and removal device 36 comprises, inter alia, a normal force applicator and removal bar 38 having the right and left ends thereof fixedly connected to right and left side plates 40 and 42, respectively. Right and left side pulley mounting plates 44 and 46 thereof are fixedly mounted on right and left side plates 40 and 42, respectively. Right and left side pulleys 48 and 50 are rotatably connected to the aforementioned right and left side pulley mounting plates 44 and 46, respectively. Trained around the aforementioned pulleys is normal force applicator and removal leveling cable 52 having its ends fixedly attached to support structure of the apparatus (not shown).

Attached to the front side undersurface of normal force applicator and removal bar 38, and contiguous thereto, is an isolation pad 54. Contiguous and adhesively attached to isolation pad 54 is a normal force transfer pad 56. A filler pad 58 fills the void created on the back undersurface of normal force applicator and removal bar 48 by the aforementioned isolation and normal force transfer pads. A last document simulator pad 60, made out of a material closely simulating the static friction of a document is fixedly attached to the topside of normal force applicator and removal bar 38 around filler pad 58 and adhesively attached to normal force transfer pad 56 forming thereby, the actual surface of normal force applicator and removal device 36 that contacts document stack 32.

Figure 3:
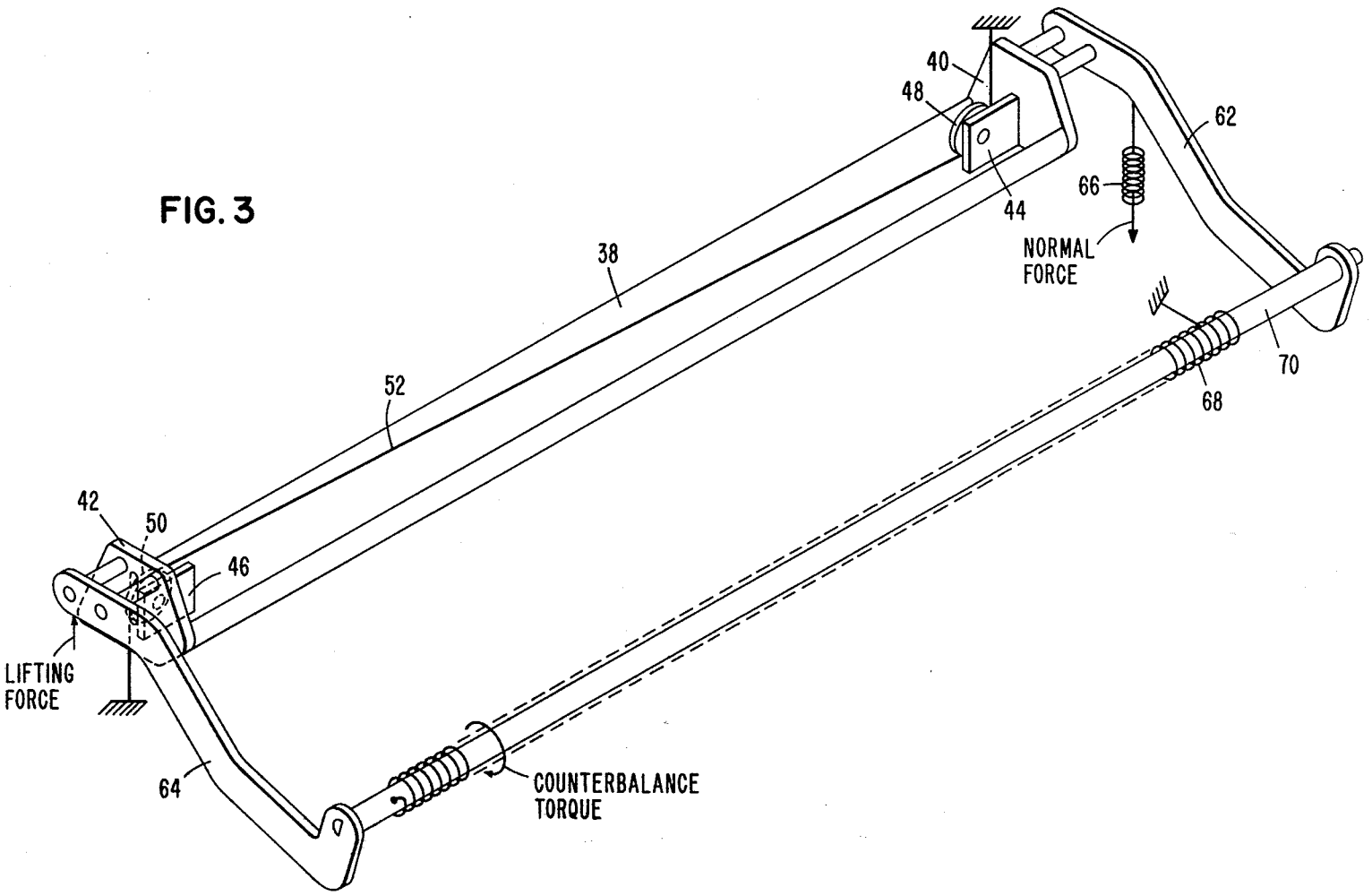
FIG. 3 is a partial perspective view, primarily of the counterbalance device, according to the invention, depicting the balancing of the weight of the normal force applicator and removal bar.

Referring generally to FIGS. 1 and 2, but specifically to FIG. 3, ends of right and left side links 62 and 64 are fixedly attached to right and left side plates 40 and 42, respectively. A normal force extension spring 66 is operatively connected to right side link 62. A counterbalance force, as shown, is generated by a counterbalance torsion spring 68 being wrapped around counterbalance torsion spring arbor 70 which is disposed between and fixedly attached to the other ends of right and left side links 62 and 64.

Other elements of the apparatus, according to the invention, not yet described, are described and their operation outlined in conjunction with the above-described elements under the heading "Statement of the Operation" hereintofollow.

Statement of the Operation

The normal force applicator and removal apparatus, according to the present invention, in a first mode of operation, is used to apply a normal force to a document stack to generate and maintain a shingled stack of documents, and to vary the normal force applied as a function of the thickness of the document stack. The apparatus is configured to generate the shingled stack of documents at a substantially constant predetermined rate of, for example 37 documents per minute. This corresponds, in system operation, to a normal force range of three pounds to one pound as the document stack is depleted, and a shingler wheel speed of, for example, 700 revolutions per minute when normal force is applied and 1000 revolutions per minute when normal force is not applied. It should be noted that increasing or decreasing the foregoing parameters will increase or decrease the rate of shingling. The second mode of operation is to remove the normal force from the document stack after the shingled stack has been formed. Thus, the operation of the apparatus, according to the invention, consists of applying a normal force to build up the shingled stack of documents whereupon the normal force is released and then of reapplying the normal force to rebuild the shingled stack of documents as necessary. At times, especially with a full document stack, the weight of the stack alone is sufficient to maintain the shingled stack.

Referring then to FIG. 4 and again to FIG. 3, with the particular embodiment shown, the capacity of document tray 10 is approximately 100 documents of 20 pound bond stock. However, the apparatus, according to the invention, lends itself to a document stack capacity more or less than that specified, depending on the particular application. Moreover, the apparatus, according to the invention, will shingle documents in the range of 9 pound to 120 pound card stock, as well as document sizes ranging from 3×5 cards up to 11×17 stock.

When document stack 32 is placed into document tray 10 by an operator, the force thereof pushes against normal force applicator and removal device 36, particularly the portion thereof comprising isolation pad 54, normal force pad 56, filler pad 58 and last document simulator pad 60. This force assists in moving normal force applicator and removal device 36 up, allowing the entering of document stack 32 thereunder and up against gross shingler bar 16.

This force assist action, as depicted in FIG. 3, is due to a counterbalancing force mainly generated by counterbalance torsion spring 68. Counterbalance torsion spring 68 applies a torque in a clockwise direction on left side link 64 and causes it to pivot very slightly in the clockwise direction. As left side like 64 pivots, it exerts a lifting force on left side plate 42 of normal force applicator and removal bar 38. This lifting force causes left side pulley 50 to track up which causes right side pulley 48 to also track up due to normal force applicator and removal leveling cable 52 being wrapped around the pulleys and situated therebetween. Accordingly, the counterbalancing force generated by counterbalance torsion spring 68 tends to balance out the weight of normal force applicator and removal bar 38 and associated elements so that when an operator inserts document stack 32, as aforementioned, the counterbalancing action and the force generated by the insertion of the document stack tends to easily make normal force applicator and removal device 36 move upwardly.

Further, and still referring to FIG. 3, normal force applicator and removal bar 38 stays parallel as it is moved upwardly or downwardly. This results from the unique configuration and coaction of right and left side pulleys 48 and 50, normal force applicator and removal leveling cable 52 and right and left side links 62 and 64. Normal force applicator and removal leveling cable 52 is adjusted such that normal force applicator and removal bar 38 is parallel to the top of document stack 32 and is then rigidly anchored at each end as shown in FIG. 3. Thus, as a normal force is applied to right side link 62, normal force applicator and removal bar 38 will move downward and remain parallel to the top of document stack 32 due to the tracking of normal force applicator and removal leveling cable 52. Likewise, as a clockwise torque is applied to left side link 64, normal force applicator and removal bar 38 will move upward and remain parallel to the top of document stack 32 again due to the tracking of normal force applicator and removal leveling cable 52. The weight of normal force applicator and removal bar 38 is balanced by counterbalance torsion spring 68 and associated elements such as left side link 64 which is fixedly connected to counterbalance torsion spring arbor 70 having counterbalance torsion spring 68 wrapped therearound and fixed thereto. Consequently, operation is such as to balance out weight of normal force applicator and removal bar 38 and associated elements allowing it to be freely moved up as documents are inserted in document tray 10, and to freely move down following document stack 32 as it is depleted. Gross shingler bar 16 acts as a front reference edge for document stack 32. The orifice between gross shingler bar 16 and document tray 10 is adjusted in the present example, to allow about 20 documents to be shingled therethrough.

Referring again to FIG. 4, the shape of the surface underlying normal force applicator and removal bar 38 is configured to act as a paper guide so that when document stack 32 is inserted into document tray 10 the edges thereof will not be "dog-eared." In addition, the thickness of this undersurface portion is designed to simulate a document stack or a portion thereof during shingling of the last few documents of a document stack. More importantly, the elements of the undersurface, namely, isolation pad 54, normal force transfer pad 56, filler pad 58 and last document simulator pad 60, comprise materials which coact to give unique results in the operation of the present invention.

Normal force transfer pad 56 is fabricated from an elastomer which has some dampening properties but yet provides a firm surface for transmitting the normal force from normal force applicator and removal bar 38 to document stack 32. It has a Bayshore resilience number that ranges between 4 and 10. Normal force transfer pad 56 will deflect slightly when a normal force is applied and will have a slight wrap angle therein, especially during the shingling of the last few documents, (to be discussed hereinafter) to facilitate the shingling process.

In order to decrease and isolate system vibrations that would be transferred from shingler wheel 18 to normal force applicator and removal bar 38, isolation pad 54 is sandwiched between normal force transfer pad 56. Isolation pad 54 is fabricated from an elastomer having a density less than the density of normal force transfer pad 56. This pad also adds substantial acoustical dampening and has a Bayshore resilience number that ranges between 50 and 60. It is conceivable that a single elastomer material can replace the materials of isolation pad 54 and normal force transfer pad 56. However, experimentation has shown that for best operational results, taking into consideration the factors previously mentioned, two materials of the type previously described, work best in coupling the normal force to shingler wheel 18 and decoupling vibrations therefrom.

Figure 4:
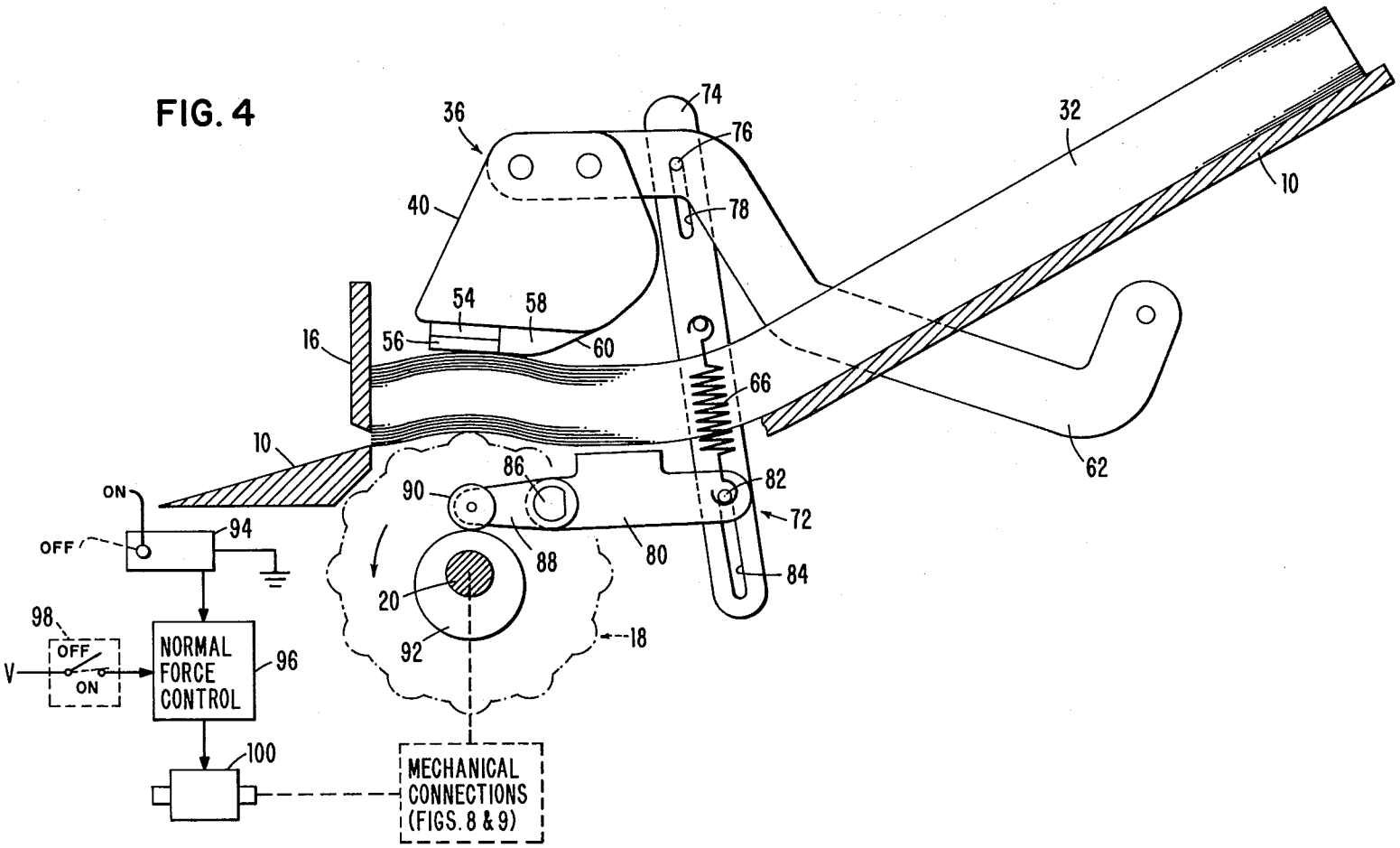
FIG. 4 is a left side sectional view of the apparatus of FIGS. 1–3, illustrating, inter alia, the condition of a normal force not being applied to a full document stack and the means for causing this condition.

Still referring to FIG. 4, filler pad 58 is made of an acoustic foam-type material and is noncritical as used in the present invention. The material of filler pad 58 has some important mechanical properties in that it has to be formed and shaped by last document simulator pad 60 as it is secured to normal force applicator and removal bar 38 (see FIG. 1). Thus, when last document simulator pad 60 is wrapped around filler pad 58, due to the compliance thereof, the shape as seen in FIG. 4 is formed filling the void created on the back undersurface of normal force applicator and removal bar 38 by isolation pad 54 and normal force transfer pad 56 being secured to the front undersurface thereof. This fabrication technique provides the necessary surface to eliminate "dog-earing" of the document stack as it is inserted in document tray 10. Of course an extruded rubber product could possibly be used, configured in the shape shown in FIG. 4, to accomplish the same result of the foam material of filler pad 58.

The underside of the foregoing pads, as previously mentioned, are covered by last document simulator pad 60 which is made of a Mylar type material. The frosted side of the Mylar is disposed facing document stack 32 and the smooth side thereof is adhesively secured to normal force transfer pad 56 and fixedly attached to normal force application and removal bar 38. Last document simulator pad 60 has two very important functions. Primarily, it simulates the surface of the last document in document stack 32 in the situation where all documents have been shingled but the last document. The reason that a last document simulator is necessary is because normal force transfer pad 56 has a coefficient of friction that is different and generally greater than the intersheet friction between two documents. Consequently, in the situation where there is one document left in document stack 32, the coefficient of friction of the frosted side of the Mylar material of last document simulator pad 60 closely approximates the coefficient of friction of a typical document. For the Mylar material used, the static coefficient of friction ranges between 0.50 and 0.70.

If there were no last document simulator pad 60, then due to the very low coefficient of friction of cylinder-like rollers 30 of shingler wheel 18 and the friction of the last document working against the substantially different friction of normal force transfer pad 56, the last document would not be shingled. This is because the shingling process is not dependent on the friction between the shingler wheel and the document being fed. Herein lies a principal difference between a shingler wheel type feeder and a friction wheel type feeder. In fact, in the example above, the last document would not move. A very important point to mention, however, is that a shingler wheel type feeder will shingle rubber sheets. But here as in the shingling of any material, it is not the friction between the shingler wheel and the material being fed, but is is the intersheet friction that is of primary importance. Hence, if rubber sheets are contiguous to rubber sheets and they are to be shingled by shingler wheel 18, it can be accomplished.

In the case of the mylar material used for last document simulator pad 60, as previously mentioned, the frosted side thereof is used to simulate the coefficient of friction of paper, and, accordingly, is disposed contiguous to document stack 32. A mylar type material was chosen not only for its close approximation to the coefficient of friction of paper, but also for its wearing properties. In addition, the mylar material, due to its coefficient of friction, helps, when document stack 32 is inserted into tray 10, as a paper guide allowing an operator to more easily insert a stack of documents without damage thereto.

Still referring to FIG. 4, force applicator and removal mechanism 72 in cooperation, inter alia, with dual normal force spring link 74 is in a position where normal force is not being applied. Accordingly, right side link 62 and left side link 64 (see FIG. 3) are not in a position to cause a normal force to be applied to document stack 32.

Force applicator and removal mechanism 72 comprises dual normal force spring link 74 which is operatively connected to right side link 62 having normal force engagement pin 76 fixedly attached thereto. Dual normal force spring link 74 has machined therein normal force varying slot 78. The length of this slot is designed to properly function with the thickness range of a given document stack. Also, operatively connected to dual normal force spring link 74 is cam follower pivot link 80 which is connected to dual normal force spring link 74 via cam follower pivot link pin 82. Cam follower pivot link pin 82 operates in normal force extension spring working slot 84 of dual normal force spring link 74, aforementioned. Normal force extension spring 66, aforementioned, is also operatively connected to dual normal force spring link 74 and cam follower pivot link pin 82. However, as shown in FIG. 4, normal force extension spring 66 is not extended; therefore, a normal force is not being applied to document stack 32.

Cam follower pivot link 80 is fixedly attached to cam follower pivot shaft 86 which is spring loaded by a spring (not shown) to have a slight bias in a counter-clockwise direction such that cam follower link 88 fixedly attached thereto will press down via cam follower roller 90 onto normal force applicator and removal cam 92. Normal force applicator and removal cam 92 is shown in its bottom dead center position which is indicative of a normal force not being applied.

In operation, shingled stack depletion sensor 94 senses the absence of a shingled stack of documents when it is in the on position and senses the presence of a shingled stack of documents when it is in the off position. As shown in FIG. 4, it is in the on position; however, normal force control 96 senses that normal force control power switch 98 is in an off position and does not actuate normal force applicator and removal solenoid 100. Accordingly, via the mechanical connection, shown schematically, between normal force applicator and removal solenoid 100 and normal force applicator and removal cam 92, it is caused to be in a bottom dead center position, which, as aforementioned, is indicative of no normal force being applied.

The mechanical connection, shown schematically in FIGS. 4, 5, 6 and 7, between normal force applicator and removal solenoid 100 and normal force applicator and removal cam 92 will be fully discussed hereinafter in conjunction with FIGS. 8 and 9.

Figure 5:
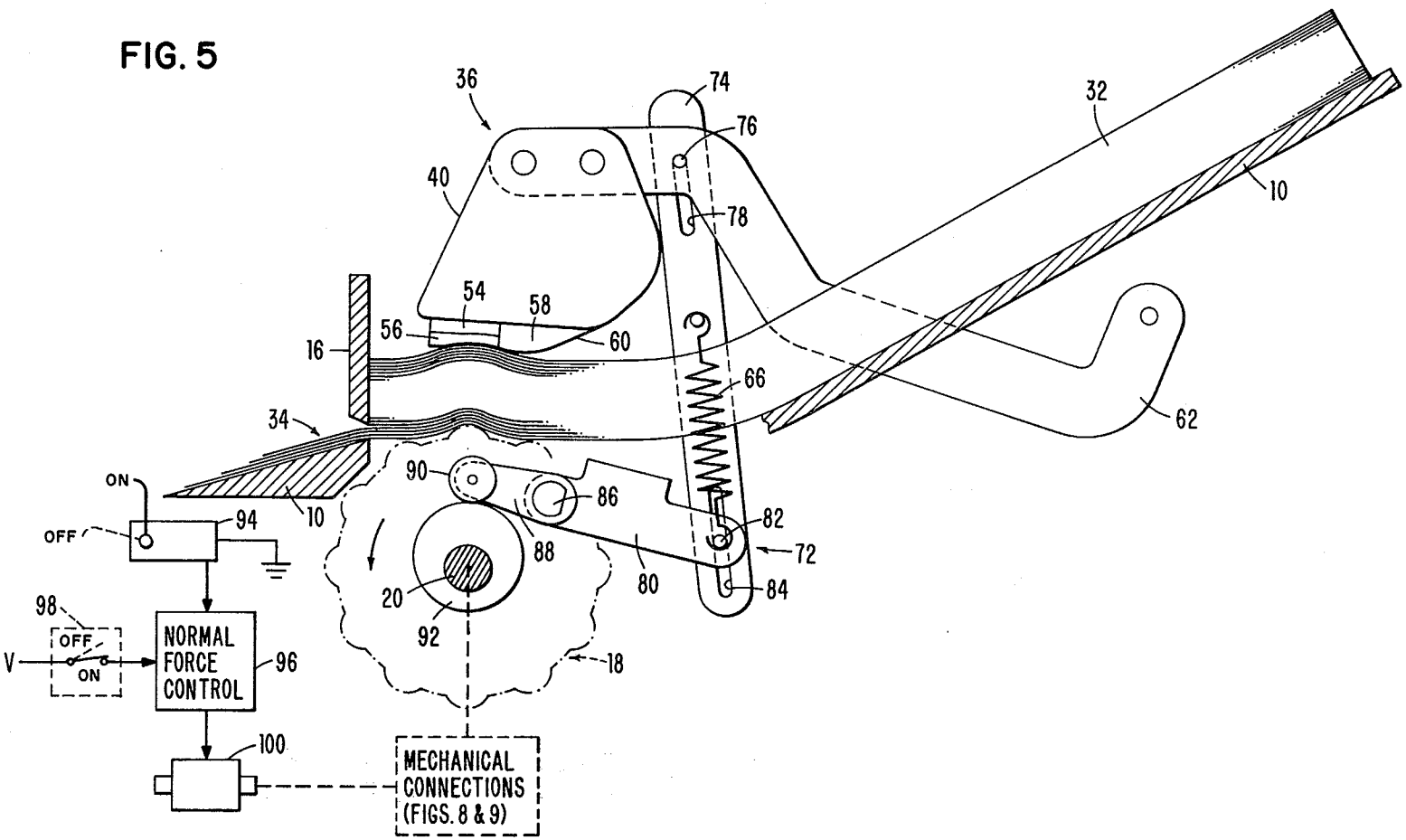
FIG. 5 is a left side sectional view of the apparatus of FIGS. 1–3, illustrating, inter alia, the condition of a normal force being applied to the full document stack and the means for causing this condition.

Referring now to FIG. 5, a normal force is shown being applied to a full document stack 32, and accordingly, the formation of shingled stack 34 begins. This situation immediately occurs when normal force control power switch 98 is turned on. This causes normal force control 96 to provide power to normal force applicator and removal solenoid 100. Due to the mechanical connection, shown in dotted lines, between normal force applicator and removal solenoid 100 and normal force applicator and removal cam 92, normal force applicator and removal cam 92 is rotated to its top dead center position which is 180 degrees from its bottom dead center position (see FIG. 4). This is the position for normal force applicator and removal cam 92 to operate on normal force extension spring 66 via cam follower pivot link 80, cam follower pivot link pin 82, cam follower link 88 and cam follower roller 90 to cause the aforementioned spring to extend causing a predetermined normal force to be applied to document stack 32. As shown, a normal force is applied since normal force engagement pin 76 is up against the top of normal force varying slot 78, and cam follower pivot link pin 82 is free to move in normal force extension spring working slot 84. Accordingly, normal force extension spring 66 is extended a fixed determined distance. This fixed determined distance translates into a normal force of about three pounds for a full document stack 32. Shingled stack 34 is generated by shingler wheel 18 rotating in a counterclockwise direction by main drive shaft 20 being driven by a motor (not shown).

For purposes of the present invention, normal force control 96 has a principal function of actuating or deactuating normal force applicator and removal solenoid 100 primarily by sensing the inputs of shingled stack depletion sensor 94 and normal force control power switch 98. As shown, the aforementioned input sources are switches; however, they can comprise any appropriate sensor or other type of switch. Normal force control 96 in carrying out its function operates in the following conditions: (1) shingled stack depletion sensor 94 on, normal force control power switch 98 off, then normal force not applied; (2) shingled stack depletion sensor 94 on, normal force control power switch 98 on, then normal force applied; and (3) shingled stack depletion sensor 94 off, normal force control power switch 98 on, then normal force not applied.

Condition 3 above is a condition where shingling has been completed at the predetermined rate (for example, 37 documents per minute) and shingled stack 34 is ready to be processed in a further processing station (not shown). Of course, when this condition occurs the shingling process should cease, and accordingly, the normal force is removed.

Figure 6:
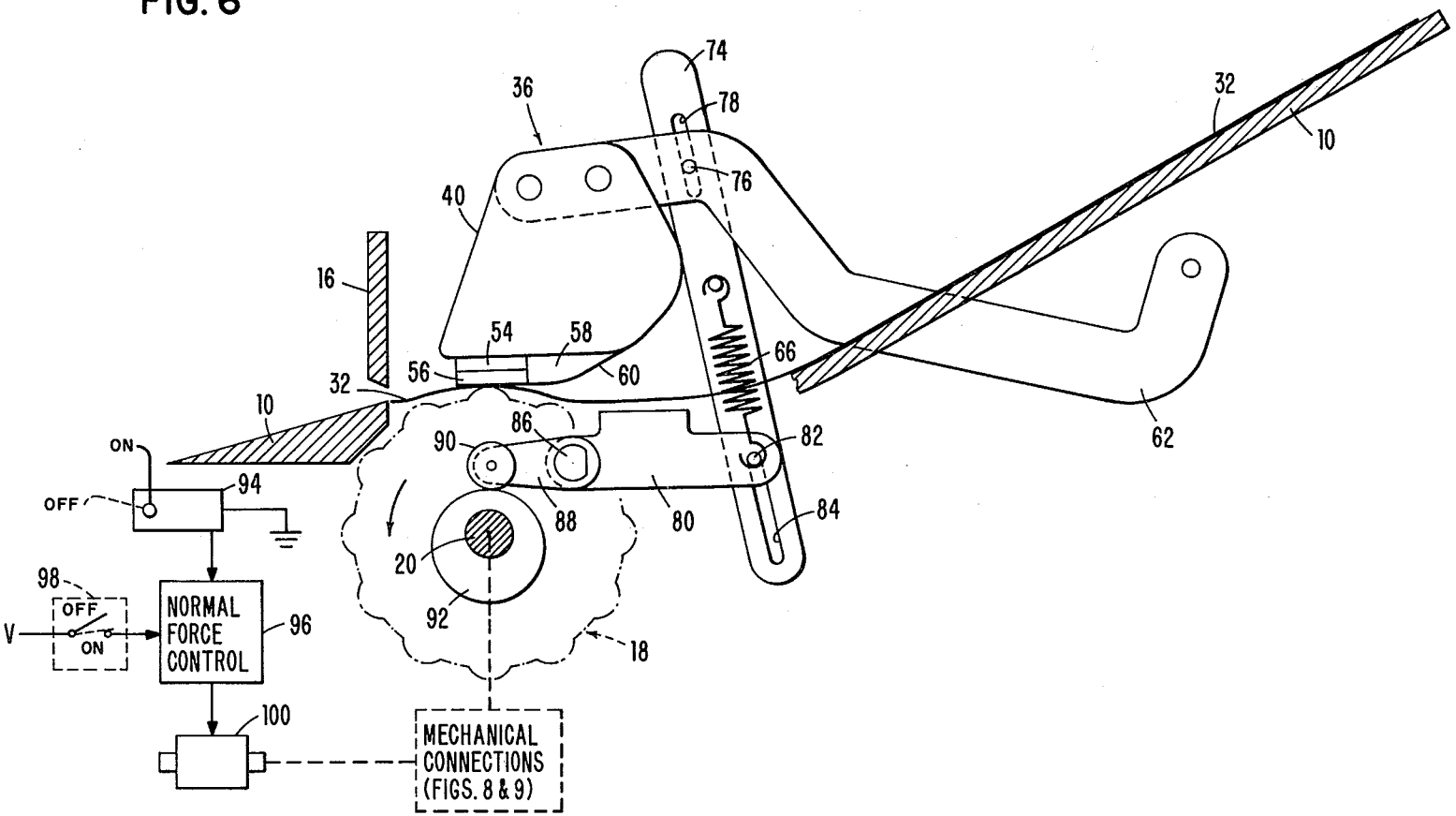
FIG. 6 is a left side sectional view of the apparatus of FIGS. 1–3 illustrating, inter alia, the condition of a normal force not being applied to the last document in the document stack and the means for causing this condition.

Referring now to FIG. 6, the situation where only one document of document stack 32 remains to be shingled is illustrated. This is an unusual condition but is not an impossible one to encounter in actual practice. FIG. 6 also shows the condition where a normal force is not being applied. (This same condition is shown in FIG. 4 for a full document stack 32).

It should be noted that the last document of document stack 32 is contiguous with last document simulator pad 60. Thus, as discussed previously, this last document will be shingled due to the friction of last document simulator pad 60 being similar to the friction of the last document. Accordingly, the intersheet friction is similar and the shingling process can take place.

Figure 7:
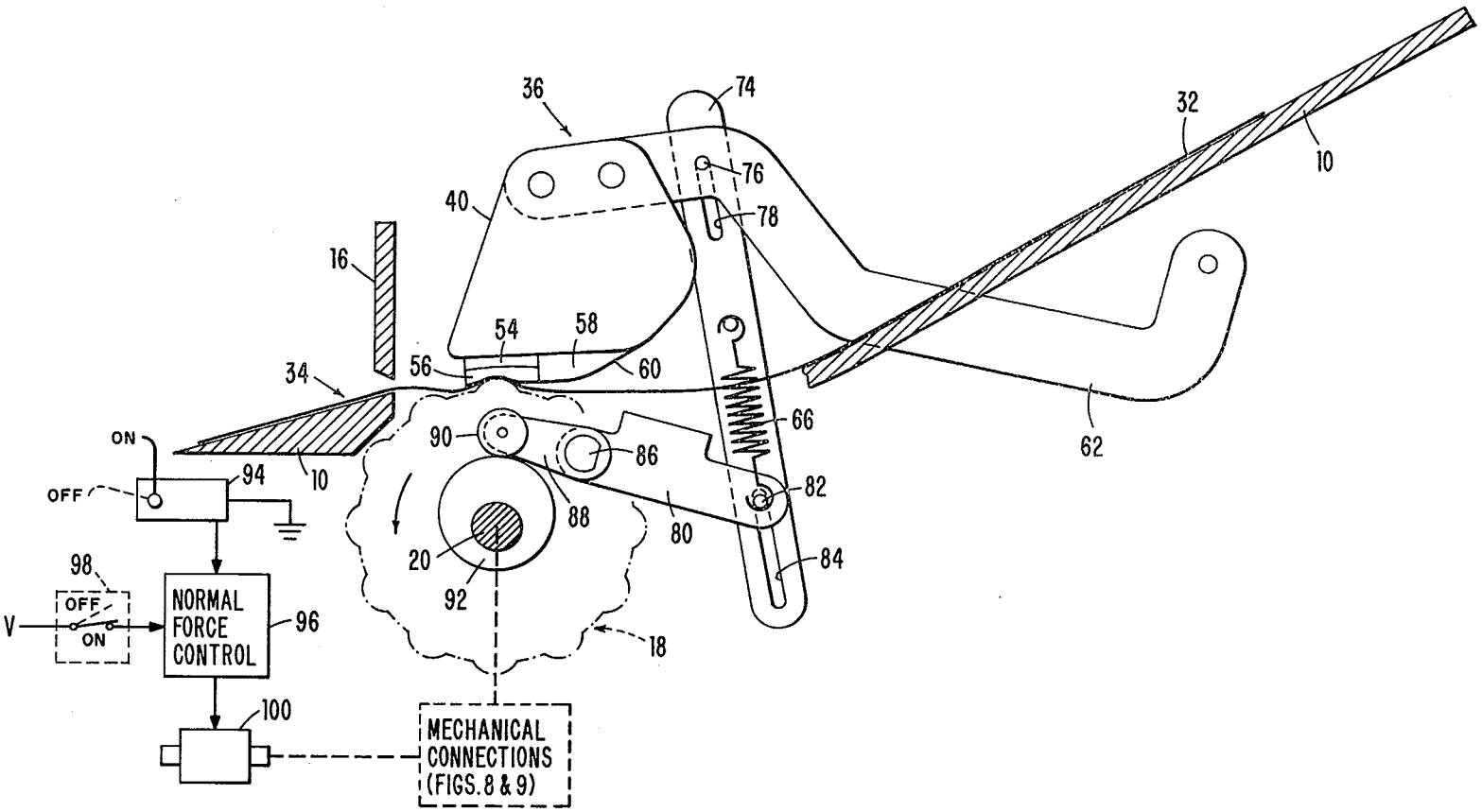
FIG. 7 is a left side sectional view of the apparatus of FIGS. 1–3, illustrating, inter alia, the condition of a normal force being applied to the last document in the document stack and the means for causing this condition.

Consequently, as shown in FIG. 7, the conditions for a normal force to be applied are met and the last document of document stack 32 is shingled forming the single document shingled stack 34. (The conditions depicted in FIG. 7 for the shingling of the last document are identical to the conditions of FIG. 5 for shingling with a full document stack 32.) In this last document shingling situation, the normal force applied is approximately one pound. Hence, the normal force is varied from three pounds when a full document stack is being shingled to one pound when the last document is being shingled.

The force variation and decrease can be understood by referring back to FIG. 6 where it is shown that normal force engagement pin 76 is toward the bottom of normal force varying slot 78 when no normal force is applied for the last document situation. Therefore, when normal force is applied in FIG. 7, normal force engagement pin 76 being fixedly attached to link 62 has to travel through a greater distance to be forced against the top of normal force varying slot 78. Accordingly, since cam follower pivot link pin 82, in the case of a full document stack or the last document travels the same distance, a force variation and decrease is caused by the distance of travel of the top of normal force varying slot 78 before engagement with normal force engagement pin 76. The greater the distance traveled by the top of normal force varying slot 78 before engagement with normal force engagement pin 76, the smaller the applied normal force.

A similar situation for a full document stack 32 can be seen by referring to FIGS. 4 and 5 concurrently, where normal force engagement pin 76 is shown at the top of normal force varying slot 78 in both conditions of normal force applied and normal force not applied. Consequently, the maximum normal force of three pounds is applied in the case of a full document stack 32.

Also, as can be clearly seen by referring again to FIGS. 5 and 7 for the two cases illustrated, cam follower pivot link pin 82, in both situations, moves the same distance so that the normal force applied to the document stack is a function of the thickness thereof and varies proportionately as the document stack is depleted. Thus, for the condition of a half document stack 32 (not shown), the normal force applied would be two pounds.

Figure 8:
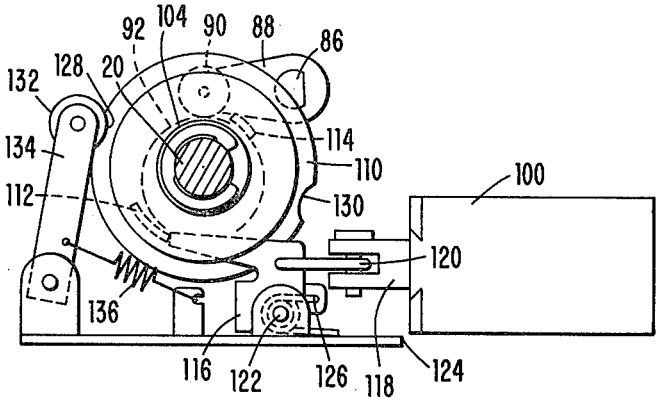
FIG. 8 is a left side view, inter alia, of the mechanical connections shown schematically in FIGS. 4 through 7.
Figure 9:
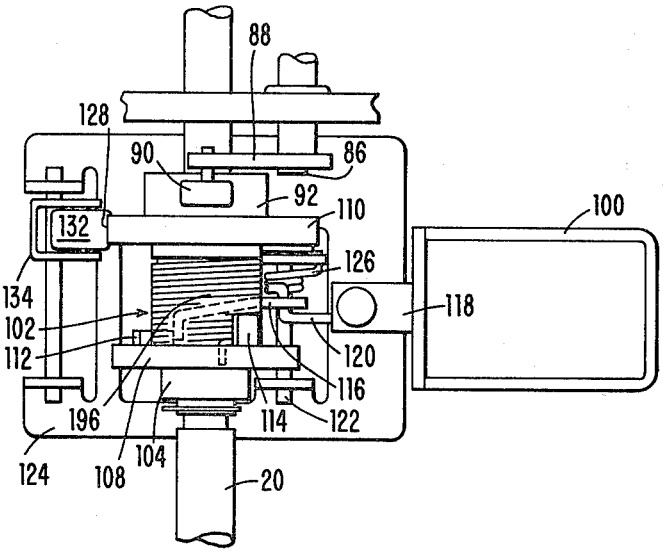
FIG. 9 is a plan view of the device of FIG. 8.

FIGS. 8 and 9 show the various elements, according to the invention, which operate in conjunction with normal force applicator and removal solenoid 100 to position normal force applicator and removal cam 92 at top or bottom dead center. They have been depicted schematically in FIGS. 4, 5, 6 and 7.

Referring then to FIGS. 8 and 9 concurrently, main drive shaft 20, aforementioned, supplies power to the apparatus according to the invention. Coupled to main drive shaft 20 are a plurality of elements which make up a spring clutch device 102. Included is a spring clutch arbor 104 having mounted thereon, a normal force applicator and removal spring clutch 106. Normal force applicator and removal spring clutch 106 has one end operatively connected to spring clutch ratchet 108 and the other end thereof operatively connected to normal force applicator and removal cam 92. The aforementioned elements cooperate to rotate normal force applicator and removal cam 92 from a bottom dead center position to a top dead center position and vice versa. Power to accomplish the foregoing is derived from main drive shaft 20 which is always rotating. This power is acquired, when desired, by operation of normal force applicator and removal solenoid 100. Normal force applicator and removal solenoid 100 is shown not actuated, which corresponds to the condition where normal force applicator and removal cam 92 is at a bottom dead center position and normal force is not being applied.

Still referring to FIGS. 8 and 9 concurrently, attached to the periphery of spring clutch ratchet 108 is normal force removal tab 112 operative to cause a normal force to be removed. Attached 180 degrees therefrom is normal force applicator tab 114 operative to cause a normal force to be applied. As shown, bell crank 116 is in contact with normal force removal tab 112 which corresponds to a normal force not being applied.

Spring clutch arbor 104 is fixedly connected to main drive shaft 20. Spring clutch ratchet 108 is slidably connected to spring clutch arbor 104. Detent ring 110 is fixedly attached to normal force applicator and removal cam 92 which is slidably connected to main drive shaft 20. Normal force applicator and removal spring clutch 106 is operatively attached to spring clutch ratchet 108, spring clutch arbor 104 and normal force applicator and removal cam 92. Thus, when bell crank 116 is in contact with normal force removal tab 112, as shown, normal force applicator and removal spring clutch 106 is unwound. Now since normal force applicator and removal solenoid 100 is not actuated, a normal force is not applied and normal force applicator and removal cam 92 is at bottom dead center.

When normal force is to be applied, normal force applicator and removal solenoid 100 is actuated at which time normal force applicator and removal solenoid plunger 118 is pulled back into the aforementioned solenoid which causes bell crank pivot link 120 to follow. Accordingly, bell crank 116 pivots upwardly about bell crank pivot shaft 122 which is fixedly attached to support bracket 124. Bell crank spring 126 provides some bias on bell crank pivot shaft 122 causing this pivoting action to be mechanically smooth and damped and causes bell crank 116 to return to its rest position when normal force applicator and removal solenoid 100 is deactivated. When bell crank 116 pivots upwardly, it is forced into the path of normal force applicator tab 114. Accordingly, when bell crank 116 is in contact with normal force applicator tab 114, a normal force is applied, because then normal force applicator and removal spring clutch 108 is allowed to wind around spring clutch arbor 104 thereby moving normal force applicator and removal cam 92 from top dead center to bottom dead center.

To continue, as shown, detent ring 10 has therein two detents 128 and 130 situated 180 degrees apart and corresponding to normal force being applied and normal force not being applied, respectively. These detents mesh with detent roller 132 which essentially provides stationery position points to keep normal force applicator and removal cam 92 either at top dead center or bottom dead center. Consequently, detents 128 and 130 also correspond to the bottom dead center and top dead center positions of normal force applicator and removal cam 92, respectively. Detents 128 and 130 are necessary to keep normal force applicator and removal spring clutch 106, when actuated or deactuated, from being in a nonstable condition.

Detent roller 132 is rotatably connected to detent arm 134, which, in turn, is pivotably connected to support bracket 124. Detent arm 134 is biased slightly clockwise by detent arm bias spring 136 causing the detent action to be mechanically smooth and damped.

While the present invention has been particularly described with reference to the preferred embodiment thereof, it will be understood by those skilled in the art that various changes in form and detail may be made therein without departing from the spirit and scope of the present invention:

What is claimed is:

1. In a document feeder for feeding a plurality of documents simultaneously from a document stack in a shingle fashion to form a shingled stack of documents, said document feeder including a shingler wheel having cylinder-like rollers for engaging the bottom of said document stack, and for shingling forward said plurality of documents simultaneously to form said shingled stack of documents, the improvement comprising:

a normal force applicator and removal means adapted to rest on the top of said document stack balanced at substantially zero weight when a normal force is not being applied, to follow the top of and be contiguous to said document stack as it is depleted and to provide a decreasing normal force to and through said document stack as it is depleted, said decreasing normal force being centered about said cylinder-like rollers such that a wrap angle is formed in said document stack about said cylinder-like rollers as said shingler wheel rotates in said shingling forward direction, thereby generating said shingled stack of documents, while substantially eliminating skewing thereof.

2. The document feeder of claim 1, the improvement further comprising:

a normal force control means cooperating with said shingler wheel and said normal force applicator and removal means such that said decreasing normal force is applied only if said shingled stack of documents is totally depleted, or if shingling of said document stack falls below a substantially constant predetermined rate, and at all other times said decreasing normal force is removed or not applied.

3. The normal force applicator and removal means of claim 1 further comprising:

a normal force applicator and removal device for applying and removing said decreasing normal force from said document stack, said normal force applicator and removal device being disposed above the top of said document stack and parallel thereto;

a counterbalance means for cooperating with said normal force applicator and removal device such that the weight thereof is balanced to substantially zero when said decreasing normal force is not being applied, such that said normal force applicator and removal device is maintained parallel to the top of said document stack regardless of the thickness thereof as said document stack is depleted and such that said normal force applicator and removal device follows and remains contiguous to the top of said document stack as it is depleted; and a normal force executing means for cooperating with said counterbalance means such that said decreasing normal force is applied or removed from the top of said document stack in order to generate or maintain said shingled stack of documents at a substantially constant predetermined rate.

4. A normal force applicator and removal device for a document stack comprising:

a normal force applicator and removal bar having a flat front undersurface and a convex arcuate back undersurface, in reference to the direction of document insertion from back to front into said document stack, said normal force applicator and removal bar being disposed above the top of said document stack parallel thereto for transferring to and removing a normal force from the top of said document stack;

an isolation pad adhesively attached along said flat front undersurface of said normal force applicator and removal bar for isolating and dampening therefrom mechanical vibrations from the rotation of a shingler wheel;

a normal force transfer pad adhesively attached contiguously to said isolation pad for providing a firm surface for transferring said normal force from said normal force applicator and removal bar, while still providing some isolation and dampening of said mechanical vibrations from the rotation of said shingler wheel; and a filler pad for filling the void created on said arcuate back undersurface of said normal force applicator and removal bar by the thickness of said isolation pad and said normal force transfer pad on said front flat undersurface thereof.

5. The normal force applicator and removal bar of claim 4 wherein a last document simulator pad is adhesively attached contiguously to said isolation pad and fixedly attached to the top back surface of said normal force applicator and removal bar contigous to and compressing said filler pad forming thereby a substantially smooth, compliant and arcuate back undersurface for said normal force applicator and removal bar such that it performs as a guide for the insertion of said document stack, and such that said last document simulator pad simulates the surface of a document in order to allow shingling of the last document of said document stack.

6. The isolation pad of claim 4 which consists of an elastomeric material having a measured Bayshore resilience number in the range of 40 to 60.

7. The normal force transfer pad of claim 4 which consists of an elastomeric material having a measured Bayshore resilience number in the range of 4 to 10.

8. The last document simulator pad of claim 5 which consists of a mylar material having a measured static coefficient of friction in the range of 0.50 to 0.70.

9. The normal force applicator and removal device of claim 4 wherein said isolation pad, said normal force transfer pad and a last document simulator pad are operatively attached to said flat front undersurface of said normal force applicator and removal bar and configured to approximate the thickness of a document stack so as to facilitate shingling of the last few documents of said document stack.

10. A normal force applicator and removal device including a bar for applying a normal force to the top of and through a document stack disposed in a document tray, and through the geometric center of a shingler wheel disposed under said document tray and against said document stack such that said shingler wheel, upon rotation generates a shingled stack of documents, the improvement comprising:

a last document simulator pad of a Mylar material having a measured static coefficient of friction in the range of 0.50 to 0.70 operatively attached to the undersurface of said bar for simulating the surface of a document in order to allow shingling of the last document of said document stack.

11. An apparatus for applying a normal force to the top of and through a document stack disposed in a document tray, and through the geometric center of a shingler wheel disposed under said document tray and against said document stack such that said shingler wheel, upon rotation, generates a shingled stack of documents at a substantially constant predetermined rate, and for removing said normal force after said substantially constant predetermined rate is reached, said apparatus comprising:

a normal force applicator and removal device for applying and removing said normal force from the top of said document stack, said normal force applicator and removal device being disposed above said document stack and parallel thereto;

a counterbalance means for cooperating with said normal force applicator and removal device such that the weight thereof is balanced to substantially zero when said normal force is not being applied, such that said normal force applicator and removal device is maintained parallel to the top of said document stack regardless of the thickness thereof as said document stack is depleted and such that said normal force applicator and removal device follows and remains contiguous to the top of said document stack as it is depleted;

a normal force executing means for cooperating with said counterbalance means such that said normal force is applied or removed from the top of said document stack in order to generate or maintain said shingled stack of documents at said substantially constant predetermined rate and such that said normal force is decreased as said document stack is depleted; and a normal force control means for cooperating with said normal force executing means to apply or remove said normal force, to position said normal force executing means to decrease said normal force as said document stack is depleted, and to actuate or deactuate, intermittently, said normal force executing means in order to generate or maintain said shingled stack of documents at said substantially constant predetermined rate.

12. The normal force applicator and removal device of claim 11 further comprising:

a normal force applicator and removal bar having a flat front undersurface and an arcuate back undersurface, said normal force applicator and removal bar being disposed above the top of said document stack parallel thereto for transferring to and removing a normal force from said document stack;

an isolation pad adhesively attached along said flat front undersurface of said normal force applicator and removal bar for isolating and dampening therefrom mechanical vibrations from the rotation of said shingler wheel;

a normal force transfer pad adhesively attached contiguously to said isolation pad for providing a firm surface for transferring said normal force from said normal force applicator and removal bar, while still providing some isolation and dampening of said mechanical vibrations from the rotation of said shingler wheel;

a filler pad for filling the void created on said arcuate back undersurface of said normal force applicator and removal bar by the thickness of said isolation pad and said normal force transfer pad on said front flat undersurface thereof; and a last document simulator pad adhesively attached contiguously to said isolation pad and fixedly attached to the top back surface of said normal force applicator and removal bar contiguous to and compressing said filler pad forming thereby a substantially smooth, compliant and arcuate back undersurface for said normal force applicator and removal bar such that it performs as a guide for the insertion of said document stack, and such that said last document simulator pad simulates a document in order to allow shingling of the last document of said document stack.

13. The isolation pad of claim 12 which consists of an elastomeric material having a measured Bayshore resilience number in the range of 40 to 60.

14. The normal force transfer pad of claim 12 which consists of an elastomeric material having a measured Bayshore resilience number in the range of 4 to 10.

15. The last document simulator pad of claim 12 which consists of a mylar material having a measured static coefficient of friction in the range of 0.50 to 0.70.

16. The isolation pad, normal force transfer pad and last document simulator pad of claim 12 coacting and configured to approximate a document stack so as to facilitate shingling of the last few documents of said document stack.

17. The counterbalance means of claim 11 further comprising:

right and left side links having ends fixedly attached to right and left sides, respectively, of said normal force applicator and removal device, a counterbalance arbor disposed between and fixedly attached to the other ends of said right and left side links;

a counterbalance spring wound around said counterbalance arbor fixedly attached to the left end thereof so as to generate a counterbalance force on said normal force applicator and removal device so that the weight thereof is balanced to substantially zero when said normal force is not being applied;

right and left side pulleys rotatably attached to right and left sides, respectively, of said normal force applicator and removal device; and a normal force applicator and removal leveling cable trained around said said right and left side pulleys and having its end fixedly attached to structure of said apparatus such that said normal force applicator and removal device is maintained parallel to the top of said document stack regardless of the thickness thereof as said document stack is depleted and such that said normal force applicator and removal device follows and remains contiguous to the top of said document stack as it is depleted.

18. The normal force executing means of claim 11 further comprising:

a dual normal force spring link operatively connected to said counterbalance means;

a normal force extension spring having one end thereof fixedly attached to said dual normal force spring link;

a normal force applicator and removal cam rotatable to a top dead center position to cause said normal force to be applied, and rotatable to a bottom dead center position to cause said normal force to be removed;

spring clutch means operatively connected to and for rotating said normal force applicator and removal cam to said top dead center position and to said bottom dead center position; and cam follower means operatively connected to said dual normal force spring link, the other end of said normal force extension spring and said normal force applicator and removal cam such that said normal force extension spring is extended when said normal force applicator and removal cam is at said top dead center position causing said normal force to be applied to the top of said document stack, such that said normal force extension spring is not extended when said normal force applicator and removal cam is at said bottom dead center position and such that said extension spring is extended less as said document stack is depleted causing said normal force when applied to decrease therewith.

* * * * *